US006729791B1

(12) United States Patent
Chen

(10) Patent No.: US 6,729,791 B1
(45) Date of Patent: May 4, 2004

(54) FOLDABLE MECHANISM FOR PLAYYARD

(75) Inventor: Shun-Min Chen, Taipei Hsien (TW)

(73) Assignee: Kenny Cheng, Taipei (TW)

( * ) Notice: Subject to any disclaimer, the term of this patent is extended or adjusted under 35 U.S.C. 154(b) by 23 days.

(21) Appl. No.: 10/269,120

(22) Filed: Oct. 10, 2002

(51) Int. Cl.[7] ..... F16C 11/10
(52) U.S. Cl. ..... 403/102; 403/218
(58) Field of Search ..... 403/102, 103, 403/101, 100, 99, 98, 104, 83, 84, 85, 218

(56) References Cited

U.S. PATENT DOCUMENTS 5,964,545 A * 10/1999 Cheng ..... 403/102
6,018,846 A 2/2000 Huang
6,223,366 B1 * 5/2001 Cheng ..... 403/102 X
6,363,550 B1 * 4/2002 Wang ..... 403/102 X

FOREIGN PATENT DOCUMENTS

GB 2 260 570 A 4/1993
GB 2 363 425 A 12/2001

* cited by examiner

*Primary Examiner*—John R. Cottingham
(74) *Attorney, Agent, or Firm*—Dorsey & Whitney LLP

(57) ABSTRACT

The present invention discloses a foldable mechanism for playard, comprising a connection element for connecting a pair of hollow rods, having an U-shaped cross section, two pairs of guiding grooves and a plurality of through holes for rivets being provided at both sides of the connection element; a pair of hollow rods in which a spring and a latching block are accommodated respectively, a through hole for rivet and a groove being provided at both sides of the hollow rods respectively; and a press-down element having two ramps, for pressing the latching block literally to disengage the engaged status between the connection element and the hollow rod, wherein the press-down element, hollow rod and latching block are fixed on the connection element by rivets, when a user presses the press-down element, the ramps of the press-down element would push the latching block to move literally so as to disengage the engaged status between the connection element and the hollow rod to achieve the effect of collapsing the playyard.

4 Claims, 4 Drawing Sheets

FOLDABLE MECHANISM FOR PLAYYARD

FIELD OF THE INVENTION

The present invention relates to a foldable mechanism for playyard, and more particular, to a foldable mechanism for playyard, which is easy to be folded, simple in structure and solid in support strength.

DESCRIPTION OF PRIOR ART

As time changes, there is a need of providing an easy-to-operate foldable mechanism with high safety for different varieties of playyards. For example, in the prior art, there is disclosed a foldable mechanism for playyard, as shown in FIG. 1, comprising a coupling element 2 having a substantially U-shaped cross section; a pair of hollow rods 3 having therein an engaging element 4; a spring 5 pivotally screwed to the coupling element 2 by a screw 6; a fixed block 7 secured in the coupling element 2, having a cutout 8 for engaging with the engaging element 4; and a press-down element 9 positioned below the fixed block 7 for disengaging the engaged status between the engaging element 4 and the fixed block 7. When a user is intended to collapse the playyard, all he or she has to do is to press down the press-down element 9 and the engaged status between the engaging element 4 and the fixed block 7 would be disengaged.

In the conventional foldable mechanism mentioned above, redundant parts are used so that the whole structure is very complicate and the cost is increased. In addition, the engaged status of the foldable mechanism for playyard relies on a fixed block 7 made of plastic and an engaging element 4 made of plastic so that the support strength thereof is not good enough. After a long period of use, the foldable mechanism is adt to malfunction due to long time wear, even infants, toddlers or children would get hurt due to the destruction of foldable mechanism in structure.

SUMMARY OF THE INVENTION

In view of the above drawbacks of conventional foldable mechanisms for playyard, the present invention simplifies the whole structure of a foldable mechanism and improves the support strength thereof.

According to one aspect of the present invention, there is provided a foldable mechanism for playyard, comprising:

- a connection element for connecting a pair of hollow rods, having an U-shaped cross section, two pairs of guiding grooves and a plurality of through holes for rivets being provided at both sides of the connection element;
- a pair of hollow rods in which a spring and a latching block are accommodated respectively, a through hole for rivet and a groove being provided at both sides of the hollow rods respectively; and
- a press-down element having two ramps, for pressing the latching block literally to disengage the engaged status between the connection element and the hollow rod,
- wherein the press-down element, hollow rod and latching block are fixed on the connection element by rivets, when a user presses the press-down element, the ramps of the press-down element would push the latching block to move literally so as to disengage the engaged status between the connection element and the hollow rod to achieve the effect of collapsing the playyard.

According to another aspect of the present invention, there is provided a foldable mechanism for playyard, wherein the guiding groove consists of a straight line part and an arch part.

According to still another aspect of the present invention, there is provided a foldable mechanism for playyard, wherein the press-down element is mounted below the connection element.

According to further another aspect of the present invention, there is provided a foldable mechanism for playyard, wherein the press-down element is mounted at the literal side of the connection element.

The present invention has a merit that the engaged status of the whole foldable mechanism for playyard relies on the latching block, rivets and connection element made of metal so that the support strength is higher than that relies on the fixed block made of plastic and the engaging element made of plastic in a conventional foldable mechanism. Further, since the foldable mechanism of the present invention uses less parts so that the manufacture cost would be reduced and the foldable mechanism is easy to be produced due to simple structure.

Additional features and other merits of the present invention will be described hereinafter together with the drawings which form a part of the specification.

DETAILED DESCRIPTION OF THE PREFERRED EMBODIMENTS

Figure 1:
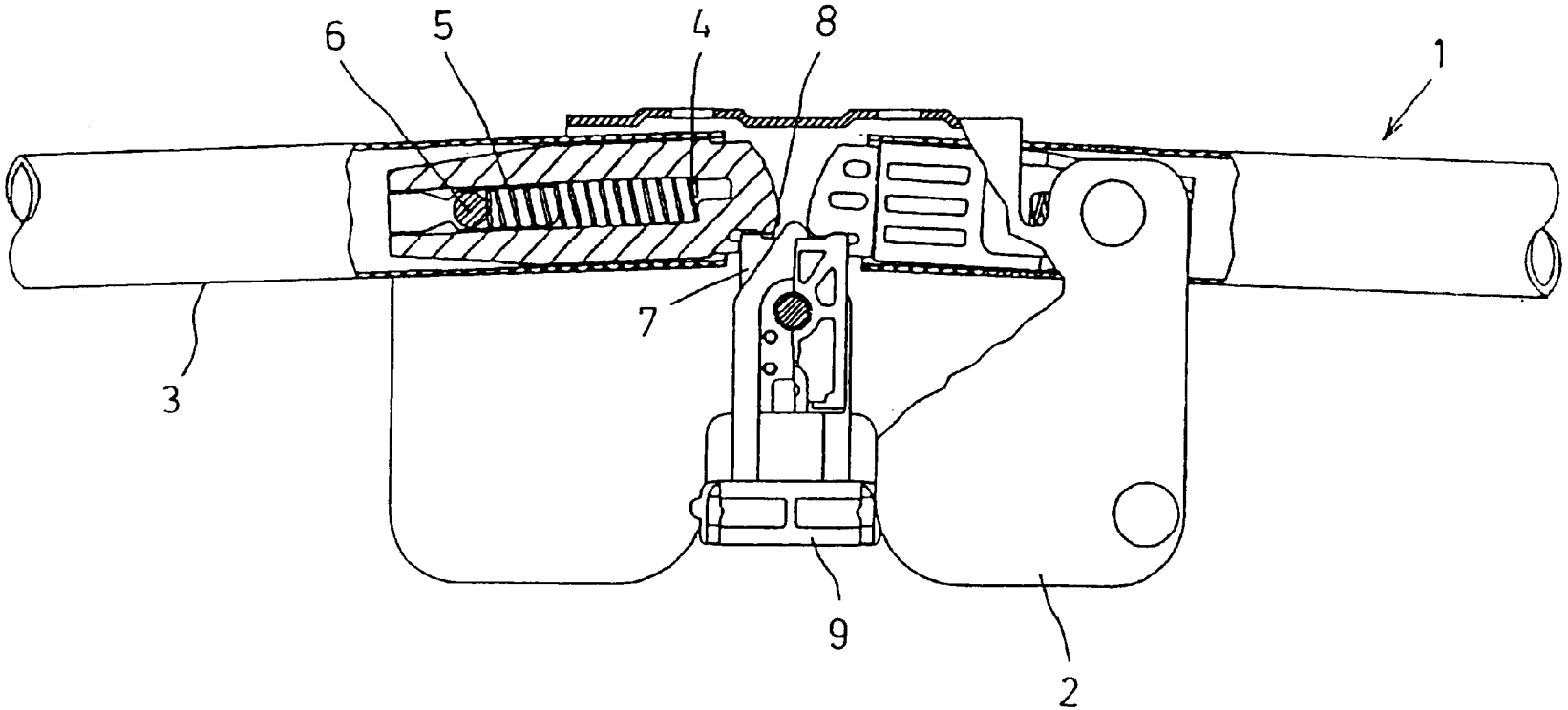
FIG. 1 is a section view of a conventional foldable mechanism for playyard.
Figure 2:
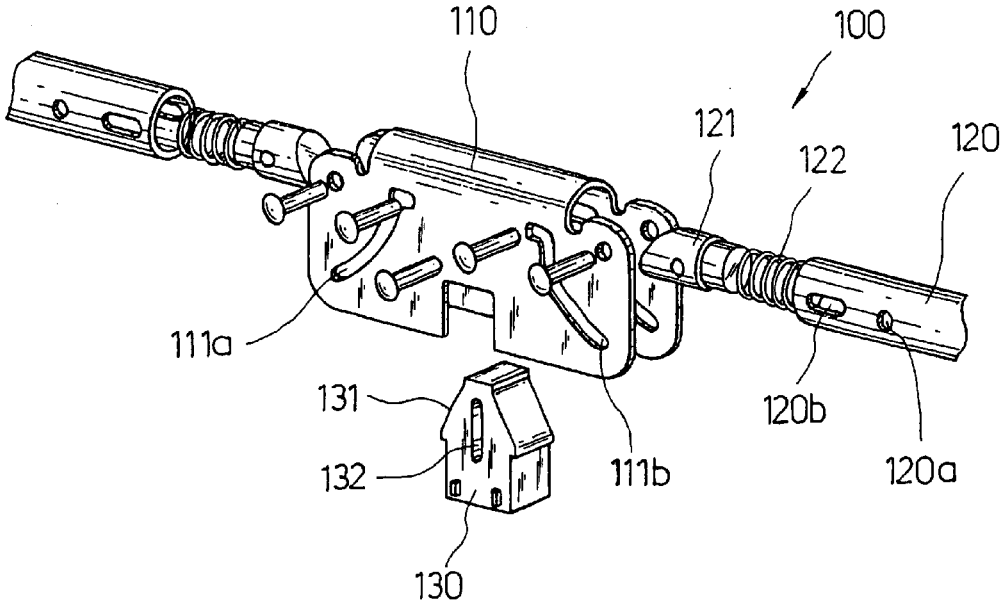
FIG. 2 is a partial exploded view of the foldable mechanism for playyard according to the first embodiment of the present invention.

With reference to FIG. 2, a foldable mechanism for playyard according to the first embodiment of the present invention is shown. As shown in FIG. 2, the foldable mechanism 100 for playyard according to the first embodiment of the present invention comprises: a connection element 110 for connecting a pair of hollow rods 120, having an U-shaped cross section, two pairs of guiding grooves 111*a* and 111*b* and a plurality of through holes for rivets being provided at both sides of the connection element 110; a pair of hollow rods 120 in which a spring 122 and a latching block 121 are accommodated respectively, a through hole 120*a* for rivet and a groove 120*b* being provided at both sides of the hollow rods 120 respectively; and a press-down element 130 having two ramps 131, for pressing the latching block 121 literally to disengage the engaged status between the connection element 110 and the hollow rod 120.

Figure 3:
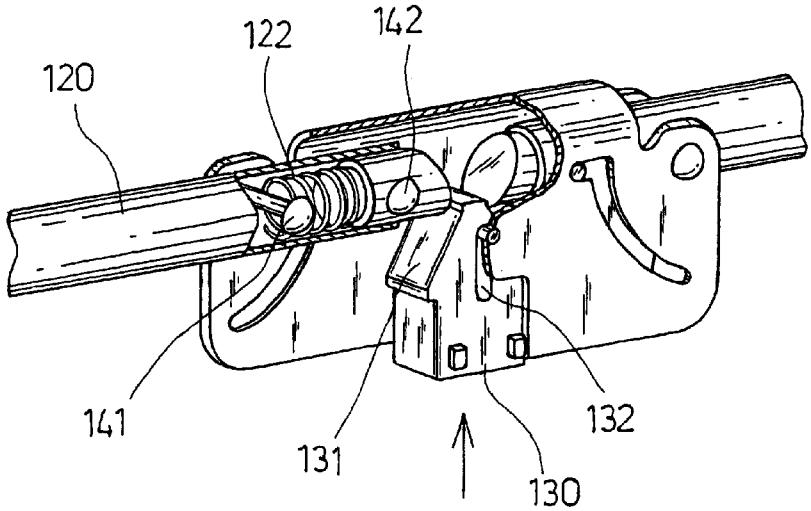
FIG. 3 is a partial cut-out view of the foldable mechanism for playyard according to the first embodiment of the present invention.

FIG. 3 is a partially cut-out view of the foldable mechanism for playyard according to the first embodiment of the present invention. As shown in FIG. 3, the hollow rods 120 are mounted on the connection element 110 by two rivets, wherein the first rivet 141 passes through the through hole for rivet of hollow rod 120 and the through hole for rivet of connection element 110, and the second rivet 142 passes through the through hole for rivet of connection element 110, the through hole for rivet of latching block 121 and the groove of hollow rod 120. The spring 122 is accommodated in the hollow rod 120 and fixed between two rivets. The press-down element 130 is mounted on the connection element 110 by a rivet passing through the through hole for rivet of connection element 110 and the sliding groove 132 of press-down element 130.

Figure 4:
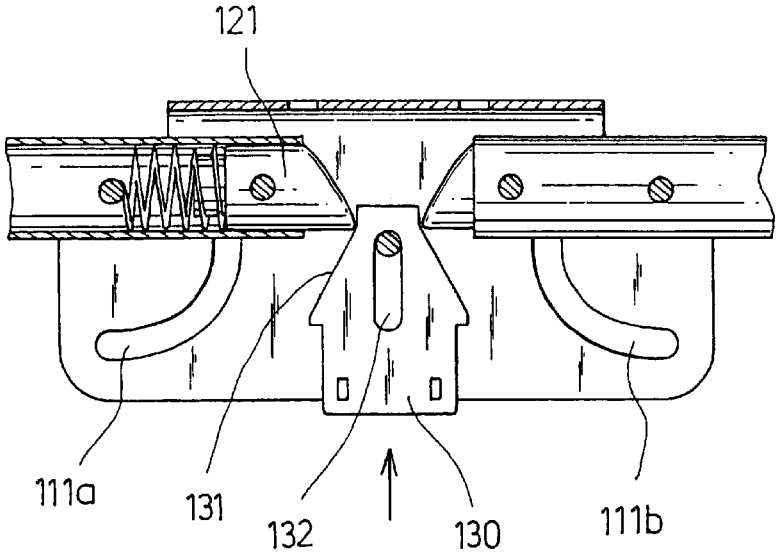
FIG. 4 is a section view of the foldable mechanism for playyard according to the first embodiment of the present invention.

FIG. 4 shows a section view of the foldable mechanism for playyard according to the first embodiment of the present invention. In operation, if a user pushes the press-down element 130 upward, then the press-down element 130 will be moved upward along the sliding groove 132. When the ramp 131 of press-down element 130 abuts against the latching block 121, the upward movement of press-down element 130 would urge the latching block 121 to move literally. Once the second rivet 142 for fixing latching block 121 is moved to the arch part of guiding groove 111*a* of connection element 110, the hollow rod 120 can be rotated around the first rivet 141, and the latching block 121 and second rivet 142 are moved along the arch part of guiding groove 111*a*. By means of the above operation, a user can disengage the engaged status between the hollow rod 120 and connection element 110 to collapse the playyard.

Figure 5:
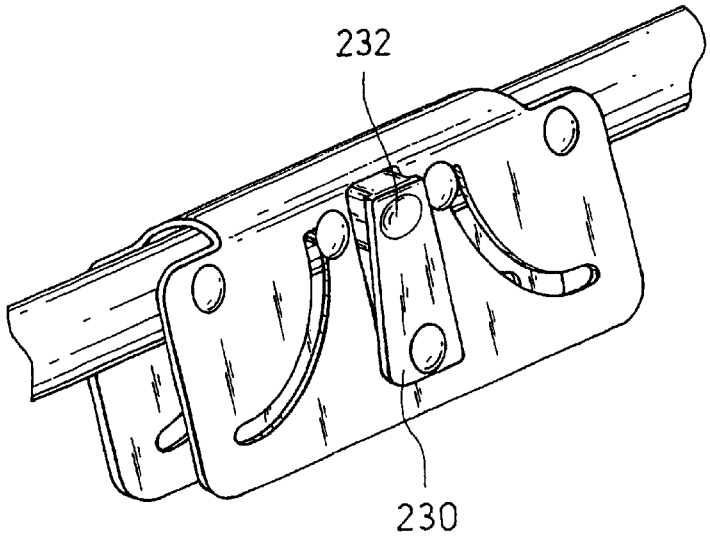
FIG. 5 is a detailed perspective view of the foldable mechanism for playyard according to the second embodiment of the present invention.
Figure 6:
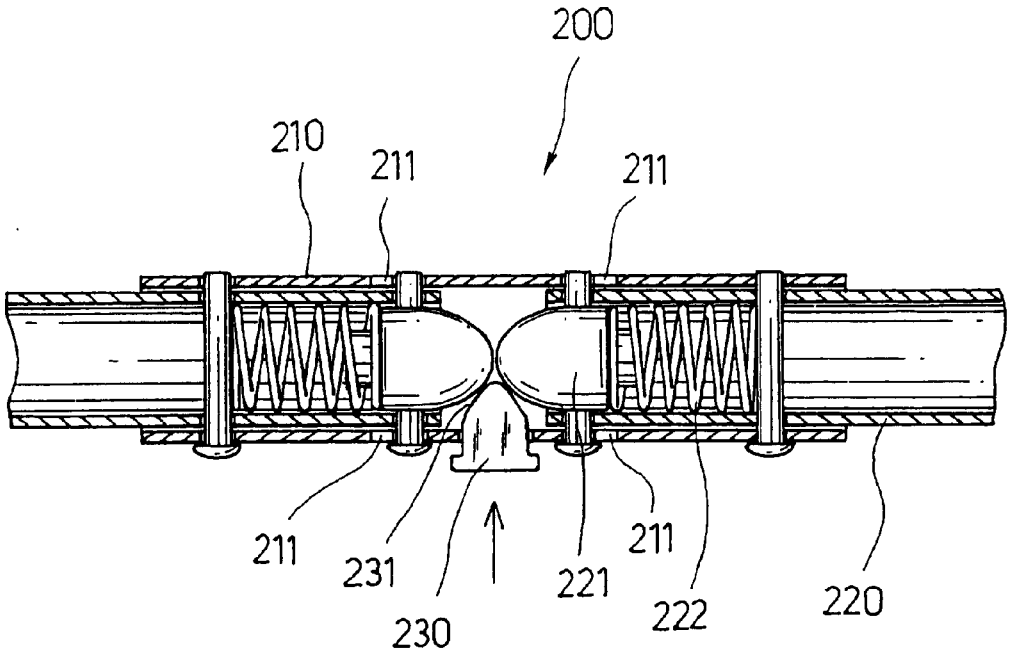
FIG. 6 is a section view of the foldable mechanism for playyard according to the second embodiment of the present invention.

FIG. 5 is a detailed perspective view of the foldable mechanism for playyard according to the second embodiment of the present invention, and FIG. 6 is a section view of the foldable mechanism for playyard according to the second embodiment of the present invention. FIGS. 5 and 6 show a foldable mechanism for playyard according to the second embodiment of the present invention, which is substantially the same as that shown in the first embodiment except that the design of press-down element is different. As shown in FIG. 5, the press-down element 230 is mounted on the side of connection element. The press-down element 230 has a recessed push button 232.

As shown in FIG. 6, the foldable mechanism 200 for playyard according to the second embodiment of the present invention comprises: a connection element 210 having two guiding grooves 211 at both sides; a pair of hollow rods 220; and a press-down element 230. A spring 222 and a latching block 221 are accommodated in the hollow rod 220. The operation principle of the second embodiment is similar to that of first embodiment. When a user pushes the press-down element 230, the ramp 231 of press-down element 230 would abut against the latching block 221 to urge the latching block 221 to move literally. Once the latching block 221 is moved to the arch part of guiding groove 211, the engaged status between the connection element 210 and the hollow rod 220 can be disengaged.

The foldable mechanism for playyard according to the present invention has merits that the foldable mechanism is easy to be collapsed, the structure thereof is simple and easy to be manufactured, and the support strength thereof is more solid. The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention to thereby enable others skilled in the art to best utilize the present invention. It is intended that the scope of the present invention be defined by the Claims appended hereto and their equivalents.

What is claimed is:

1. A foldable mechanism for playyard, comprising:

a connection element for connecting a pair of hollow rods, having an U-shaped cross section, two pairs of guiding grooves and a plurality of through holes for rivets being provided at both sides of said connection element;

a pair of hollow rods in which a spring and a latching block are accommodated respectively, a through hole for rivet and a groove being provided at both sides of said hollow rods respectively; and a press-down element having two ramps, for pressing said latching block literally to disengage the engaged status between said connection element and said hollow rod, wherein said press-down element, hollow rod and latching block are fixed on said connection element by rivets, when a user presses said press-down element, said ramps of press-down element would push said latching block to move literally so as to disengage the engaged status between said connection element and said hollow rod to achieve the effect of collapsing the playyard.

2. The foldable mechanism for playyard as defined in claim 1, wherein said guiding groove consists of a straight line part and an arch part.

3. The foldable mechanism for playyard as defined in claim 1, wherein said press-down element is mounted below said connection element.

4. The foldable mechanism for playyard as defined in claim 1, wherein said press-down element is mounted at the literal side of said connection element.

* * * * *